US007215294B2

(12) United States Patent
Jocher

(10) Patent No.: US 7,215,294 B2
(45) Date of Patent: May 8, 2007

(54) ANTENNA WITH REFLECTOR

(75) Inventor: Ronald William Jocher, East Hanover, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 8 days.

(21) Appl. No.: 10/443,861

(22) Filed: May 23, 2003

(65) Prior Publication Data

US 2004/0233118 A1 Nov. 25, 2004

(51) Int. Cl.
*H01Q 13/00* (2006.01)

(52) U.S. Cl. ..... 343/773; 343/775; 343/834

(58) Field of Classification Search ..... 343/773, 343/775, 783, 700 MS, 897, 898, 877, 834, 343/835, 846, 848
See application file for complete search history.

(56) References Cited

U.S. PATENT DOCUMENTS 2,270,314 A * 1/1942 Kraus ..... 343/834
2,897,496 A * 7/1959 Woodward, Jr. ..... 343/818
2,926,349 A * 2/1960 Jensen ..... 343/840
3,611,399 A * 10/1971 Rocke ..... 343/794
4,191,604 A * 3/1980 MacTurk ..... 156/245
5,506,592 A * 4/1996 MacDonald et al. ..... 343/846
5,990,845 A * 11/1999 Sharp et al. ..... 343/846
6,198,454 B1 * 3/2001 Sharp et al. ..... 343/773
6,320,509 B1 * 11/2001 Brady et al. ..... 340/572.7
6,703,981 B2 * 3/2004 Meitzler et al. ..... 343/755
2003/0002179 A1 * 1/2003 Roberts et al. ..... 359/838
2003/0103008 A1 * 6/2003 Petropoulos et al. ..... 343/702

* cited by examiner

*Primary Examiner*—Hoanganh Le

(57) ABSTRACT

An antenna which includes a monoconical antenna feed assembly, where the feed assembly has a base and an apex, a ground plane adjacent to the monoconical antenna feed assembly near the apex, and an antenna reflector coupled to the ground plane, where the antenna reflector at least partially surrounds the monoconical antenna feed assembly. The monoconical feed point is used to drive a reflector antenna. The broadband characteristics of the monoconical image vertical antenna (typical ground plane geometry) are used as the feed point for the reflector to give modest amount of gain while maintaining larger than previously developed bandwidths.

20 Claims, 3 Drawing Sheets

ANTENNA WITH REFLECTOR

BACKGROUND OF THE INVENTION

In antenna design, there are at least three overall design criteria; size relative to wavelength, directivity (or antenna gain), and frequency operating bandwidth. Generally, the first limiting design factor is frequency bandwidth and gain versus antenna size trade-off. Gain to size aspect ratios favor center feed corner reflector antennas, which is a well-understood design.

Design of the antenna feed assembly is also a relevant concern. To achieve broader frequency bandwidth, the conventional bow-tie feed is often chosen. There are two problems associated with this design, one, the conventional bow-tie feed has a 300 ohm balanced input impedance, which is a large mismatch for the typical 50 ohm unbalanced coaxial line, and two, the conventional bow-tie uses a full wavelength corner reflector, which is too large to fit into reduced space requirements.

SUMMARY OF THE INVENTION

Exemplary embodiments of the present invention may be directed to an antenna with a reflector, which do not suffer from antenna input impedance mismatch, provide increased operating frequency bandwidth, and/or reduce the antenna physical size.

Exemplary embodiments of the present invention may be directed to an antenna, which includes a monoconical antenna feed assembly. The feed assembly has a base and an apex, a ground plane adjacent to the monoconical antenna feed assembly near the apex, and an antenna reflector coupled to the ground plane. The antenna reflector at least partially surrounds the monoconical antenna feed assembly.

Exemplary embodiments of the present invention may be directed to an antenna has increased operating bandwidth and a modest amount of gain. A monoconical feed assembly may be used to illuminate a reflector antenna. The broadband characteristics of the monoconical antenna (typical ground plane geometry) may be used as the feed assembly for the reflector to give modest amount of gain, while maintaining larger than previously developed bandwidths. The reflector may provide improved antenna directivity and thus increases the antenna gain.

Exemplary embodiments of the present invention may be directed to an antenna having increased operating bandwidth. The antenna may have an impedance matched to a 50 ohm transmission line, and a modest amount of antenna gain.

BRIEF DESCRIPTION OF THE DRAWINGS

Exemplary embodiments of the present invention will become more fully understood from the detailed description given below and the accompanying drawings, which are given for purposes of illustration only, and thus do not limit the invention.

It should be emphasized that the drawings of the instant application are not to scale but are merely schematic representations, and thus are not intended to portray the specific dimensions of the invention, which may be determined by skilled artisans through examination of the disclosure herein.

DETAILED DESCRIPTION OF EXEMPLARY EMBODIMENTS

Regarding antenna design, the bandwidth criteria can be approached using the same broadband characteristics of a bi-conical cone antenna, where two cones are arranged apex-to-apex. Substituting half of this design, known as an image antenna, i.e., vertical ground plane antenna, provides a broadband feed mechanism for the reflector.

The antenna input impedance can be made to match the coaxial transmission line by determining the appropriate cone apex angle and spacing. With an image antenna feed structure, the reflector size may be reduced (to up to half the normal size), while still maintaining performance. Further, a reflector may be used to transform an omniidirectional "doughnut" shaped pattern into a pattern with increased directivity or gain.

Figure 1A:
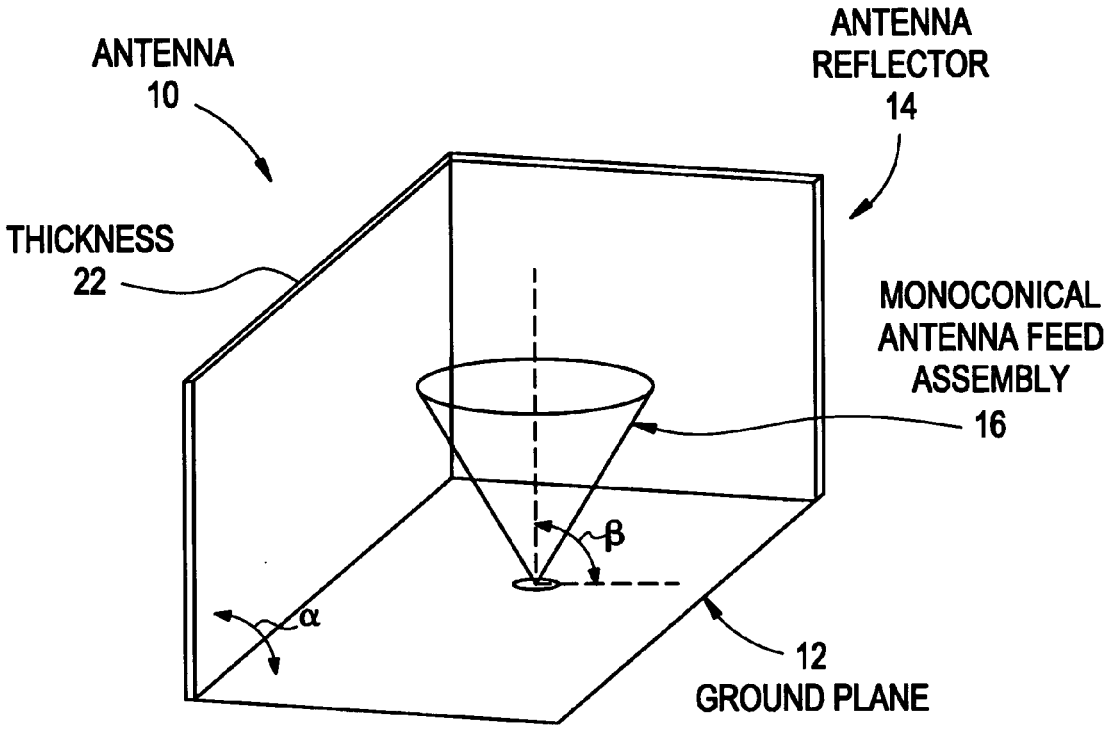
FIGS. 1A, 1B and 1C illustrate antennas with reflectors in accordance with exemplary embodiments of the present invention.
Figure 1B:
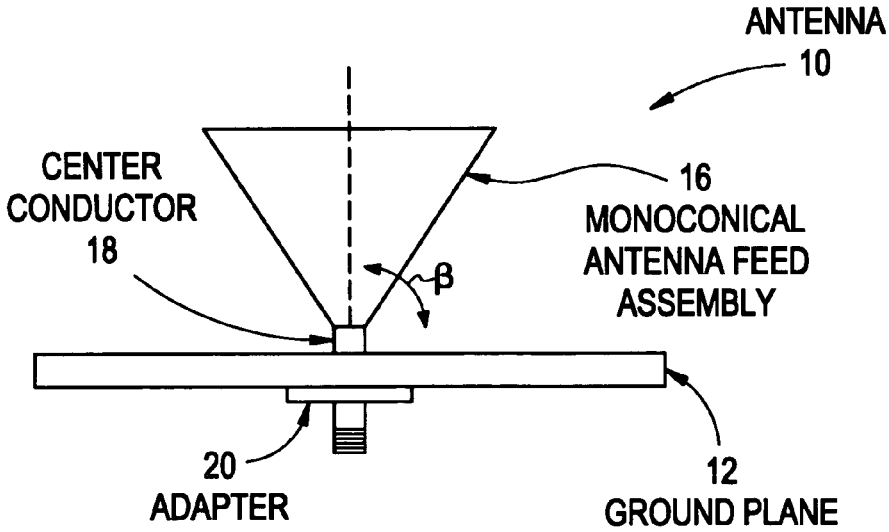

FIGS. 1A and 1B illustrates an antenna with reflector in accordance with at least one exemplary embodiment of the present invention. As shown, the antenna 10 includes a ground plane 12, an antenna reflector 14, and a monoconical antenna feed assembly 16. The monoconical feed assembly may be incorporated to increase the bandwidth. The ground plane 12 is coupled to an outer conductor of the adapter 20 and located adjacent to the monoconical antenna feed assembly 16 near the apex of the assembly 16. The antenna reflector 14 is coupled to the ground plane 12 and the antenna reflector 14 at least partially surrounds the monoconical antenna feed assembly 16. As shown in FIG. 1B, the feed assembly 16 is coupled to a center conductor 18 of the adapter 20. In exemplary embodiments of the present invention, the antenna reflector 14 is a modified corner antenna reflector, as shown in FIG. 1A. In exemplary embodiments of the present invention, the antenna reflector 14 is a solid metal antenna reflector, a mesh antenna reflector, or a plurality of bars. In other exemplary embodiments of the present invention, the antenna reflector 14 is a combination of solid metal, mesh, and/or bars with or without varying thickness 22.

In exemplary embodiments of the present invention, the antenna 10 has a reduced size in terms of wavelength, improved directivity, and wider bandwidth. In exemplary embodiments of the present invention, the bandwidth is 1800–2200 MHz to accommodate cell phone systems, PCS, UMTS and other wireless systems.

In exemplary embodiments of the present invention, the antenna 10 is vertically polarized and an image antenna, however, both of these need not be the case, as would be known to one of ordinary skill in the art.

In exemplary embodiments of the present invention, the antenna reflector 14 partially surrounds the monoconical antenna feed assembly 16. The degree of surrounding may be from 90° to 180°. In exemplary embodiments of the present invention, the antenna reflector 14 is a corner antenna reflector, which surrounds 180° of the monoconical antenna feed assembly 16.

Figure 1C:
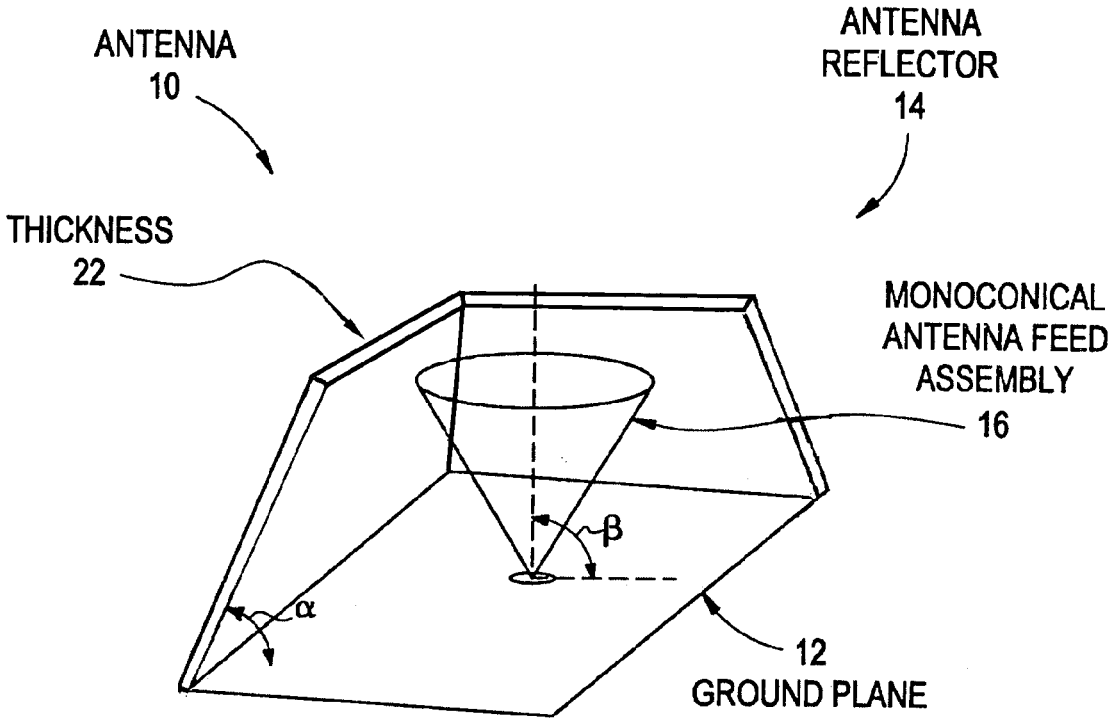

In exemplary embodiments of the present invention, the orientation of the antenna reflector 14 to the monoconical antenna feed assembly 16 is not vertical, as shown in FIGS. 1A and 1B by angel $\alpha$, but rather sloped at another angle, for example, 10°, 20°, 30°, 45°, or 60°, as shown by FIG. 1C.

In exemplary embodiments of the present invention, an outer surface of the monoconical antenna feed assembly 16 and/or the outer surface of the ground plane 12 comprises a conductive material.

In other exemplary embodiments of the present invention, the ground plane 12 is made of conductive metal and the monoconical antenna feed assembly 16 comprises an insulating material coated with conducting metal material.

In exemplary embodiments of the present invention, the adapter 20 is a coaxial cable adapter. In other exemplary embodiments of the present invention, the adapter 20 may be any type adapter of either sex. Such types may be standard or special and include, but not be limited to, DIN series connectors, including DIN 7/16, N-type, TNC, SMA, and MMX.

In exemplary embodiments of the present invention, the feed point spacing can be adjusted with the center conductor 18 of the adapter 20. In exemplary embodiments of the present invention this adjustment can be made utilizing a threaded mechanism.

Figure 2:
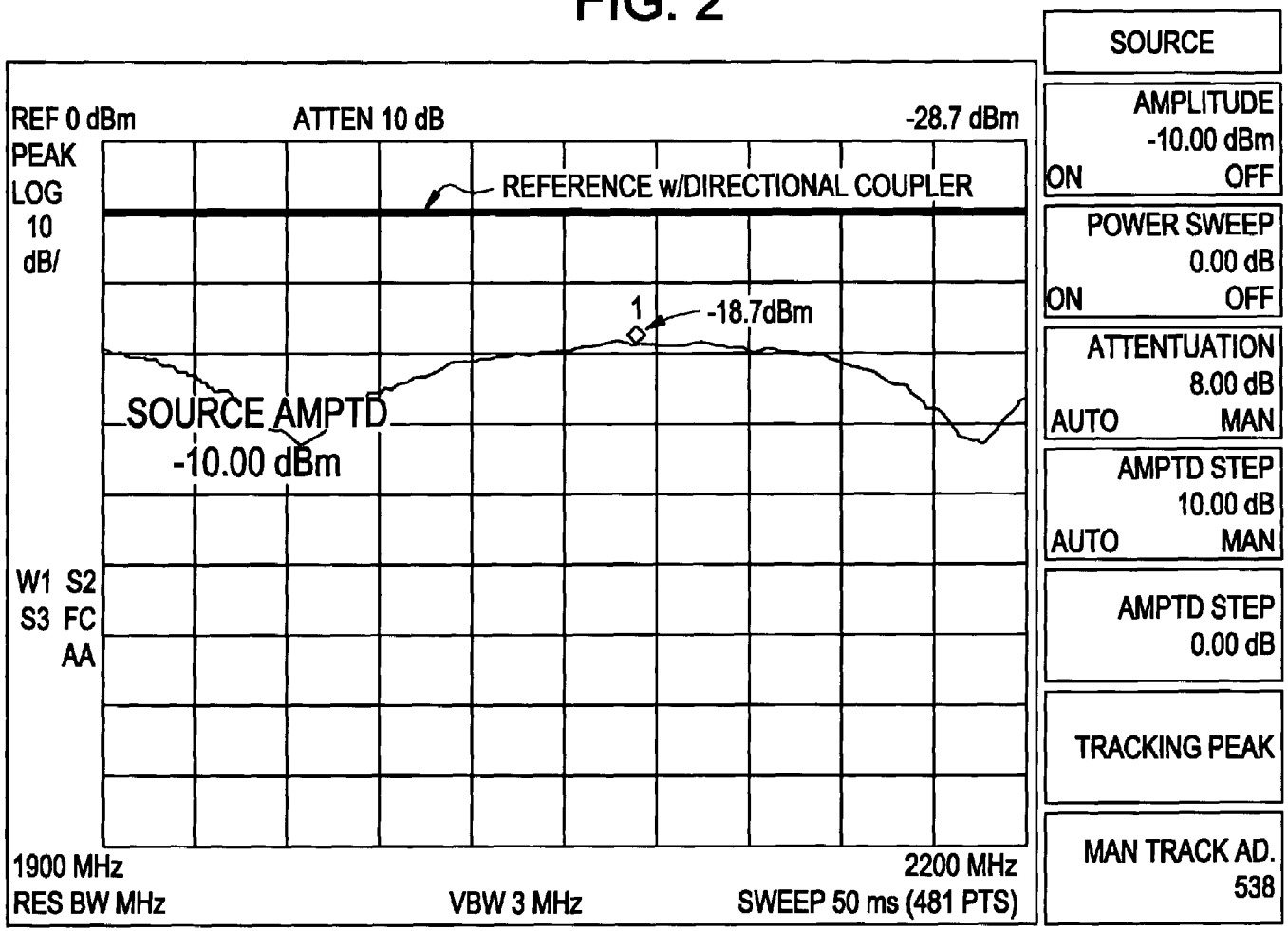
FIG. 2 illustrates operating results when using a 30° monoconical cone according to at least one exemplary embodiment of the present invention.

Antenna return loss measurements were conducted. Measurements were conducted using a 90°, 45°, 30°, 20°, and 10° apex angle monoconical antenna feed assembly. The reflector to feed probe distance was adjusted to obtain improved return loss values while observing the antenna operating frequency bandwidth. FIG. 2 shows the operating results when using the 30° cone (experimentally, the best match to 50 ohms). As shown, an 18.7 dB return loss (Standing Wave Ratio of 1.23) was obtained, which is a highly desirable value.

Exemplary embodiments of the present invention can operate in multiple bands, for example, the standard PCS wireless band and the new UMTS wireless band simultaneously. This encompasses a frequency range from 1900 to 2200 MHZ, or a frequency bandwidth of 15% centered at 2050 MHZ.

Additionally, exemplary embodiments of the present invention are small enough to be installed into limited space areas and have predictable operating performance, and/or be low cost.

Initial antenna testing with various feed configurations has determined antenna feedpoint impedance and reflector to feed spacing. Antenna gain and beamwidth tests have gains from 4–5 dB with a half wavelength corner reflector.

Although exemplary embodiments of the present invention are generally described in the context of wireless telephony, the teachings of the present invention may be applied to other systems, wired or wireless, voice, data or a combination thereof, as would be known to one of ordinary skill in the art.

The invention being thus described, it will be obvious that the same may be varied in many ways. Such variations are not to be regarded as departure from the spirit and scope of the exemplary embodiments of the present invention, and all such modifications are intended to be included within the scope of the following claims.

I claim:

1. An antenna comprising:

a monoconical antenna feed assembly having a base and an apex;

a ground plane located adjacent to said monoconical antenna feed assembly proximate the apex;

an antenna reflector coupled to said ground plane, said antenna reflector at least partially surrounding said monoconical antenna feed assembly;

wherein the orientation of the reflector to the monoconical feed assembly is sloped at a first non-vertical angle relative to the ground plane, the orientation of the monoconical feed assembly is sloped at a second angle relative to the ground plane, and the first non-vertical angle is different from the second angle.

2. The antenna of claim 1, wherein said antenna reflector is a modified corner antenna reflector.

3. The antenna of claim 1, wherein said antenna reflector is a solid metal antenna reflector.

4. The antenna of claim 1, wherein said antenna reflector is a mesh antenna reflector.

5. The antenna of claim 1, wherein said antenna reflector includes a plurality of bars.

6. The antenna of claim 1, wherein said antenna reflector includes a combination of solid metal, mesh, and bars.

7. The antenna of claim 1, wherein said antenna reflector includes a varying depth in thickness.

8. The antenna of claim 1, wherein said antenna has a reduced size in terms of wavelength, improved directivity, and wider bandwidth.

9. The antenna of claim 8, wherein the bandwidth is 1800–2200 MHz.

10. The antenna of claim 1, wherein said sloped antenna reflector is sloped at one of 30°, 45° and 60° from horizontal.

11. The antenna of claim 10, wherein the ground plane comprises a conductive metal and the monoconical antenna feed assembly comprises an insulating material coated with conducting material.

12. The antenna of claim 10, further comprising:

an adapter structure connected to the ground plane.

13. The antenna of claim 1, wherein an outer surface of the monoconical antenna feed assembly comprises a conductive material and/or the outer surface of the ground plane comprises a conductive material.

14. An antenna comprising:

a ground plane; and means, connected to said ground plane, for increasing at least one of directivity and bandwidth of said antenna, wherein said means include a monoconical antenna feed assembly and an antenna reflector, wherein said antenna reflector at least partially surrounds said monoconical antenna feed assembly, the orientation of the reflector to the monoconical feed assembly is sloped at first non-vertical angle relative to the ground plane, the orientation of the monoconical feed assembly is sloped at a second angle relative to the ground plane, and the first non-vertical angle is different from the second angle.

15. The antenna of claim 14, wherein said monoconical antenna feed assembly is coupled to said ground plane, and has a base and an apex.

16. The antenna of claim 15, wherein said antenna reflector is coupled to said ground plane.

17. The antenna of claim 16, wherein said antenna reflector is a modified corner antenna reflector.

18. The antenna of claim 16, wherein said antenna reflector includes a combination of solid metal, mesh, and bars.

19. The antenna of claim 16, wherein said antenna reflector includes a varying depth in thickness.

20. The antenna of claim 16, wherein said sloped antenna reflector is sloped at one of 30°, 45° and 60° from horizontal.

* * * * *